US010199193B2

(12) United States Patent
Ito

(10) Patent No.: US 10,199,193 B2
(45) Date of Patent: Feb. 5, 2019

(54) ELECTROMAGNETIC RELAY

(71) Applicant: PANASONIC INTELLECTUAL PROPERTY MANAGEMENT CO., LTD., Osaka (JP)

(72) Inventor: Masahiro Ito, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 5 days.

(21) Appl. No.: 15/688,211

(22) Filed: Aug. 28, 2017

(65) Prior Publication Data

US 2018/0061600 A1 Mar. 1, 2018

(30) Foreign Application Priority Data

Aug. 31, 2016 (JP) ..... 2016-169589

(51) Int. Cl.
*H01H 50/32* (2006.01)
*H01H 50/30* (2006.01)
(Continued)

(52) U.S. Cl.
CPC ..... *H01H 50/321* (2013.01); *H01H 9/443* (2013.01); *H01H 50/14* (2013.01); *H01H 50/30* (2013.01); *H01H 50/42* (2013.01); *H01H 51/06* (2013.01); *H01H 51/28* (2013.01); *H01H 51/30* (2013.01); *H01H 51/36* (2013.01); *H01H 50/38* (2013.01); *H01H 50/443* (2013.01); *H01H 50/642* (2013.01)

(58) Field of Classification Search
CPC ..... H01H 51/28; H01H 9/443; H01H 50/14; H01H 50/30; H01H 50/321; H01H 50/42; H01H 51/06; H01H 51/30; H01H 51/36; H01H 50/38; H01H 50/443; H01H 50/642
See application file for complete search history.

(56) References Cited

U.S. PATENT DOCUMENTS 2,391,692 A * 12/1945 Estes ..... H01H 50/30 335/269
2,417,758 A * 3/1947 Immel ..... H01H 50/30 335/156
(Continued)

FOREIGN PATENT DOCUMENTS

DE 1815613 A1 * 8/1969 ..... H01H 50/34
JP 2015-216052 A 12/2015

*Primary Examiner* — Mohamad Musleh
(74) *Attorney, Agent, or Firm* — Greenblum & Bernstein, P.L.C.

(57) ABSTRACT

An electromagnetic relay includes an electromagnet device, an armature and a fixed terminal. By coil current through a coil, the electromagnet device generates first magnetic flux that forces the armature and the electromagnet device together or apart in a first end in a first direction of the armature. The armature is connected with a movable contact at a second end of the first direction and forces the movable contact and a fixed contact together or apart according to coil current. The fixed terminal is electrically connected with the fixed contact, and provided around the armature so as to cross the armature as seen from a second direction perpendicular to the first direction with the armature closing the fixed and movable contacts. Electric current through the fixed terminal generates a second magnetic flux in the armature, a direction of which is opposite to that of the first magnetic flux.

9 Claims, 16 Drawing Sheets

(51) Int. Cl.

| | |
|---|---|
| ***H01H 51/06*** | (2006.01) |
| ***H01H 51/28*** | (2006.01) |
| ***H01H 51/30*** | (2006.01) |
| ***H01H 51/36*** | (2006.01) |
| ***H01H 9/44*** | (2006.01) |
| ***H01H 50/14*** | (2006.01) |
| ***H01H 50/42*** | (2006.01) |
| *H01H 50/44* | (2006.01) |
| *H01H 50/38* | (2006.01) |
| *H01H 50/64* | (2006.01) |

(56) References Cited

U.S. PATENT DOCUMENTS

| | | | | | |
|---|---|---|---|---|---|
| 2,421,642 | A * | 6/1947 | Obszarny | H01H 51/06 | 335/126 |
| 2,426,068 | A * | 8/1947 | Taliaferro | H01H 50/30 | 16/277 |
| 2,690,487 | A * | 9/1954 | Anderson | H01H 50/30 | 335/124 |
| 2,875,303 | A * | 2/1959 | Immel | H01H 9/443 | 218/26 |
| 3,109,078 | A * | 10/1963 | Malone | H01H 51/06 | 318/783 |
| 3,336,546 | A * | 8/1967 | De Lucia | H01H 51/28 | 218/142 |
| 2009/0072935 | A1* | 3/2009 | Yuba | H01H 9/443 | 335/201 |
| 2015/0325385 | A1 | 11/2015 | Kinoshita | | |
| 2015/0325399 | A1* | 11/2015 | Kinoshita | H01H 50/641 | 335/189 |

* cited by examiner

ELECTROMAGNETIC RELAY

CROSS REFERENCE TO RELATED APPLICATION

This application claims the benefit and priority of Japanese Patent Application No. 2016-169589, filed on Aug. 31, 2016, the entire contents of which is incorporated herein by reference.

TECHNICAL FIELD

The present disclosure relates to an electromagnetic relay.

BACKGROUND ART

In the configuration of a related electromagnetic relay, it has been known to force fixed and movable contacts together or apart by magnetic force of a driving unit (electromagnetic device) (for example, JP 2015-216052 A (hereinafter referred to as "Document 1")). The electromagnetic device described in Document 1 includes a fixed contact, a movable contact, the driving unit that generates magnetic flux according to coil current, and an armature that is driven through the driving unit. In the electromagnetic device, the armature is connected with the movable contact through a card, and driven through the driving unit, thereby rotating toward an iron core of the driving unit.

The electromagnetic device described in Document 1 has a possibility that in case an opening speed of the fixed and movable contacts is slow, a lifetime thereof is shortened as a result of the progression of degradation of the fixed and movable contacts caused by electric arc therebetween. The configuration where large current is interrupted in particular requires a long period of time during which the fixed and movable contacts' surface metal is evaporated by the electric arc therebetween and then changed into a vapor. It is accordingly difficult to interrupt the electric arc because dielectric strength in space between the fixed and movable contacts decreases.

SUMMARY

The present disclosure has been achieved in view of the above circumstances, and an object thereof is to provide an electromagnetic relay capable of increasing an opening speed of fixed and movable contacts.

An electromagnetic relay according to a first aspect of the present disclosure includes a fixed contact, a movable contact, an electromagnet device, an armature and a fixed terminal. The movable contact is configured to make or break a connection with the fixed contact. The electromagnet device includes a coil and is configured to generate first magnetic flux by coil current flowing through the coil. A first end, in a first direction, of the armature comes into contact with the electromagnet device and separates therefrom by the first magnetic flux. A second end, in the first direction, of the armature is connected with the movable contact (through a card). The armature is configured to force the fixed and movable contacts together and apart according to the coil current. The fixed terminal is electrically connected to the fixed contact. The fixed terminal is provided around the armature with the fixed terminal crossing the armature as seen from at least one direction perpendicular to the first direction of the armature with the armature forcing the fixed and movable contacts together. Electric current flowing through the fixed terminal generates a second magnetic flux in the armature, a direction of which is opposite to that of the first magnetic flux.

BRIEF DESCRIPTION OF THE DRAWINGS

The figures depict one or more implementations in accordance with the present teaching, by way of example only, not by way of limitation. In the figures, like reference numerals refer to the same or similar elements where.

DETAILED DESCRIPTION

Figure 1:
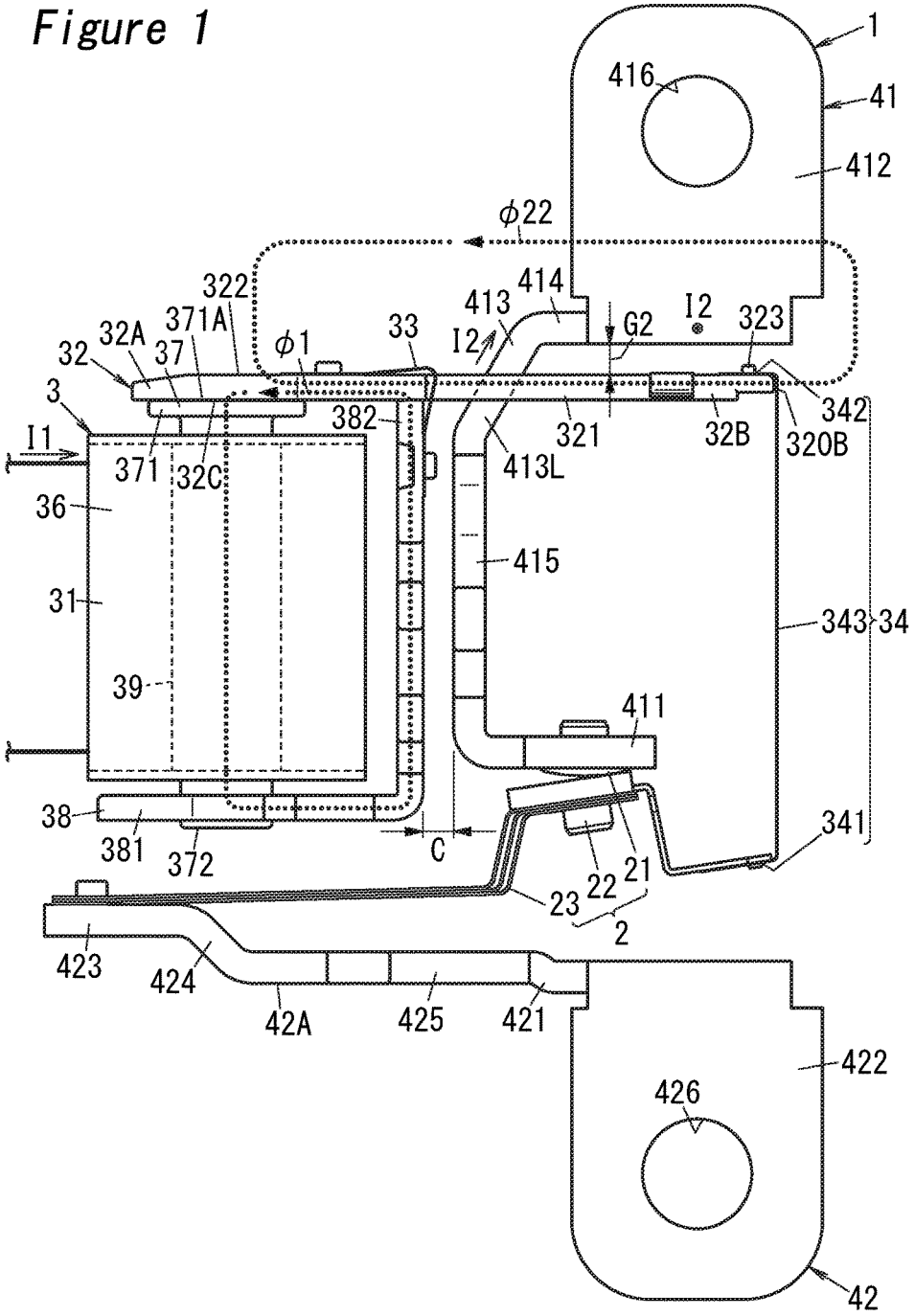
FIG. 1 is a front view of part of an electromagnetic relay when it is on, in accordance with Embodiment 1 of the present disclosure.

Electromagnetic relays according to Embodiments 1 and 2 will be explained with reference to the drawings.

Embodiment 1

As shown in FIGS. 1 to 6, an electromagnetic relay according to Embodiment 1 preferably includes a contact mechanism 2, an actuator 3, a fixed terminal 41 and a movable terminal 42.

The contact mechanism 2 preferably includes a fixed contact 21, a movable contact 22 and a contact spring 23. The fixed terminal 41 is provided with the fixed contact 21. The movable contact 21 makes or breaks a connection with the fixed contact 21. In other words, the movable contact 22 is to come into contact with the fixed contact 21, and separate therefrom. The contact spring 23 movably supports the movable contact 22 so that the fixed and movable contacts 21 and 22 are forced together and apart.

The actuator 3 is configured to force the movable contact 22 to touch the fixed contact 21 and separate therefrom. The actuator 3 preferably includes an electromagnet device 31, an armature 32, a hinge spring 33 and a card 34.

The electromagnet device 31 is configured to drive the armature 32. The electromagnet device 31 preferably includes a bobbin 39, a coil 36, an iron core 37 and a yoke 38. The electromagnet device 31 is configured to generate first magnetic flux φ1 (magnetic field) in response to coil current I1 flowing through the coil 36.

For example, the coil 36 is formed of wire (electrical conductor) wound around the iron core 37 through the bobbin 39 that is made from insulating material such as synthetic resin. The iron core 37 is accordingly arranged coaxially with the coil 36. The yoke 38 is, for example, magnetic material and has an L shape. Electric current flows through the coil 36 by voltage applied across the coil 36, thereby exciting the electromagnet device 31.

In the armature 32, preferably a first end 32A in a lengthwise direction (a first direction, or a width direction in FIG. 2) of the armature 32 is to touch the electromagnet device 31 and separate therefrom by the first magnetic flux φ1 generated through the electromagnet device 31. For example, a second end 32B of the armature 32 in the lengthwise direction is electrically connected with the movable contact 22 (through a card 34 in the illustrated examples), and the armature 32 forces the movable contact 22 to touch the fixed contact 21 and separate therefrom in response to coil current I1.

Figure 6:
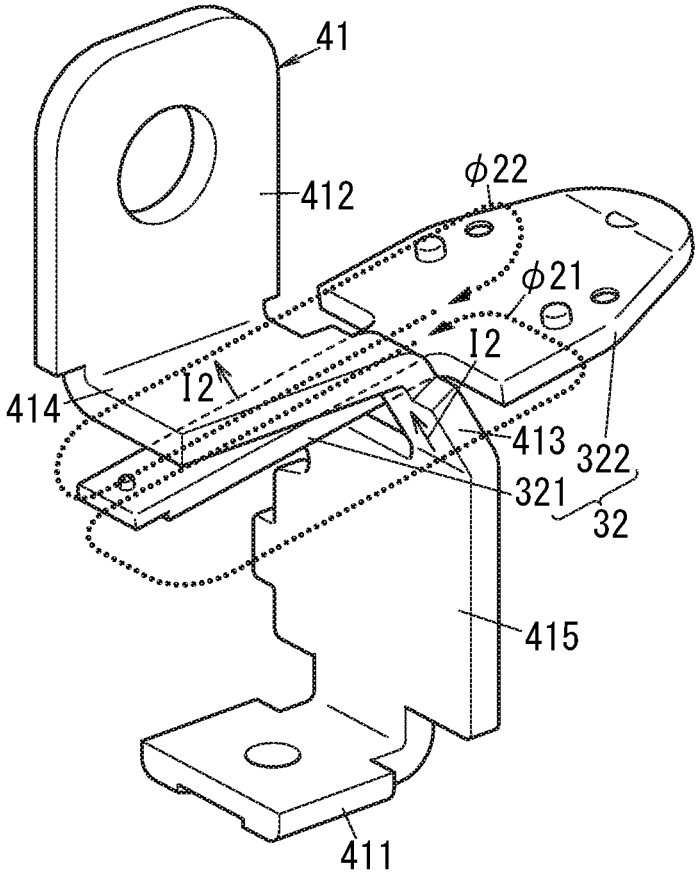
FIG. 6 is a perspective view of an armature and a fixed contact of the electromagnetic relay.

As shown in FIG. 6, the armature 32 preferably includes a driving piece 321 having a tabular band shape and a supporting piece 322 having a flat plate shape. The supporting piece 322 has, for example, a width wider than that of the driving piece 321. The driving piece 321 and the supporting piece 322 are preferably formed integrally, thereby constituting the armature 32. The hinge spring 33 is fixed to the supporting piece 322. In the embodiment, the supporting piece 322 faces an end (first end) 371 of the yoke 38. The supporting piece 322 is in contact with a tip of the yoke 38. That is, the armature 32 is hinged to the yoke 38 with the hinge spring 33.

The armature 32 is driven though the electromagnet device 31, thereby pivoting on its own contact point with the yoke 38 so that the supporting piece 322 approaches the iron core 37 (first end 371) (in FIG. 1 anticlockwise). When not driven though the electromagnet device 31, the armature 32 pivots so that the armature 32 (first end 32A) leaves the iron core 37 (in FIG. 1 clockwise).

The hinge spring 33 is composed of, for example, a leaf spring. The hinge spring 33 may be fixed (riveted) to the supporting piece 322 of the armature 32. The hinge spring 33 may also be fixed (riveted) to the yoke 38. The hinge spring 33 may be bent shaped like an L at a center thereof.

The card 34 preferably links the contact spring 23 and the armature 32. For example, the card 34 has elasticity and is fixed to the contact spring 23 and the armature 32. The card 34 is, for example, a metal plate. The card 34 preferably includes a first fixed portion 341, a second fixed portion 342 and a link portion 343. The first fixed portion 341 is fixed to, for example, the contact spring 23. The second fixed portion 342 is fixed to, for example, the armature 32. The link portion 343 preferably links the first fixed portion 341 and the second fixed portion 342. In comparison with an open and close direction of the fixed and movable contacts 21 and 22 (lengthwise direction of card 34), the card 34 is preferably flexible in a direction perpendicular to the open and close direction, or a thickness direction of the card 34.

The fixed terminal 41 is preferably provided around the armature 32 so as to cross the armature 32 as seen from at least one direction perpendicular to the lengthwise direction of the armature 32 with the armature 32 forcing the movable contact 22 to touch the fixed contact 21.

In Embodiment 1, "cross" means a combination of things in mutually different directions. In other words, "two members cross" means to be arranged so that as seen from a particular direction, the two members look as if they cross each other. Note that the definition of "cross" in Embodiment 2 (including modified examples) is similar to that in Embodiment 1.

In Embodiment 1, the fixed terminal 41 is especially provided around the armature 32 so as to cross the armature 32 as seen from two directions (second and third directions) perpendicular to the lengthwise direction (first direction) of the armature 32. Note that the lengthwise direction of the armature 32 is the width direction in FIG. 2, the second direction is a vertical direction in FIG. 2, and the third direction is a depth direction (direction perpendicular to the sheet) in FIG. 2.

Specifically, the fixed terminal 41 is electrically connected to the fixed contact 21. The fixed terminal 41 preferably includes an attachment piece 411, a terminal piece 412, a first crossing piece 413, a second crossing piece 414 and a link piece 415. For example, the attachment piece 411, the terminal piece 412, the first crossing piece 413, the second crossing piece 414 and the link piece 415 are integrally made of metallic material, thereby constituting the fixed terminal 41.

The attachment piece 411 may have a rectangular plate shape. The fixed contact 21 is preferably attached at the center of the attachment piece 411.

The terminal piece 412 may have a rectangular plate shape and is preferably linked to the second crossing piece 414. The terminal piece 412 preferably allows external equipment (not shown) to be electrically connected to. The terminal piece 412 may be formed with a screw hole 416 pierced in a center thereof and allow a terminal screw (not shown) to be screwed into.

The first crossing piece 413 preferably crosses the armature 32 as seen from the second direction of the two directions perpendicular to the lengthwise direction of the armature 32.

The second crossing piece 414 preferably connects the first crossing piece 413 and the terminal piece 412. The second crossing piece 414 preferably crosses the armature 32 as seen from the third direction (direction perpendicular to the sheet of FIG. 2) of the two directions perpendicular to the lengthwise direction of the armature 32 (width direction in FIG. 2). In other words, the second crossing piece 414 and the armature 32 may be arranged to look as if they cross as seen from the third direction.

The link piece 415 may have a rectangular plate shape, and preferably links the attachment piece 411 and the first crossing piece 413.

Figure 2:
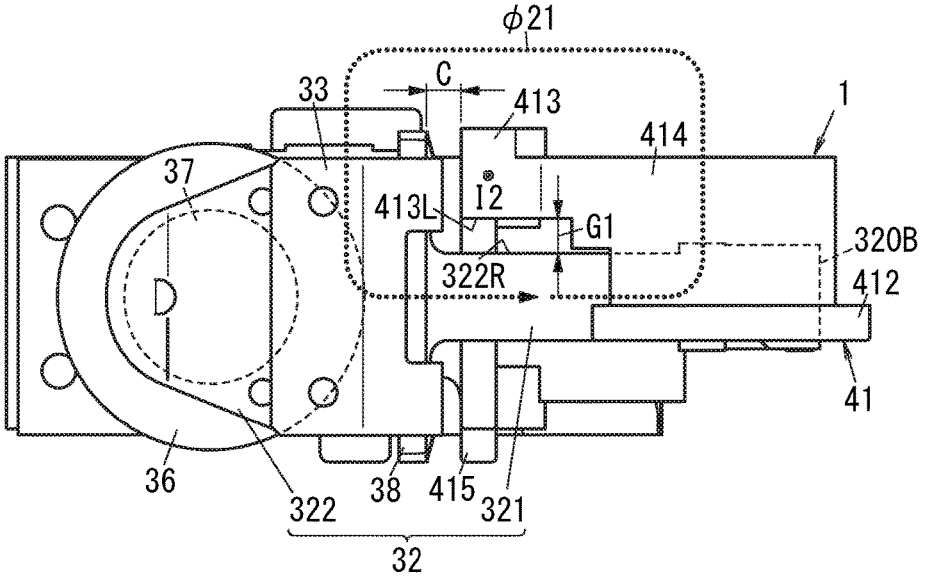
FIG. 2 is a plan of part of the electromagnetic relay.
Figure 3:
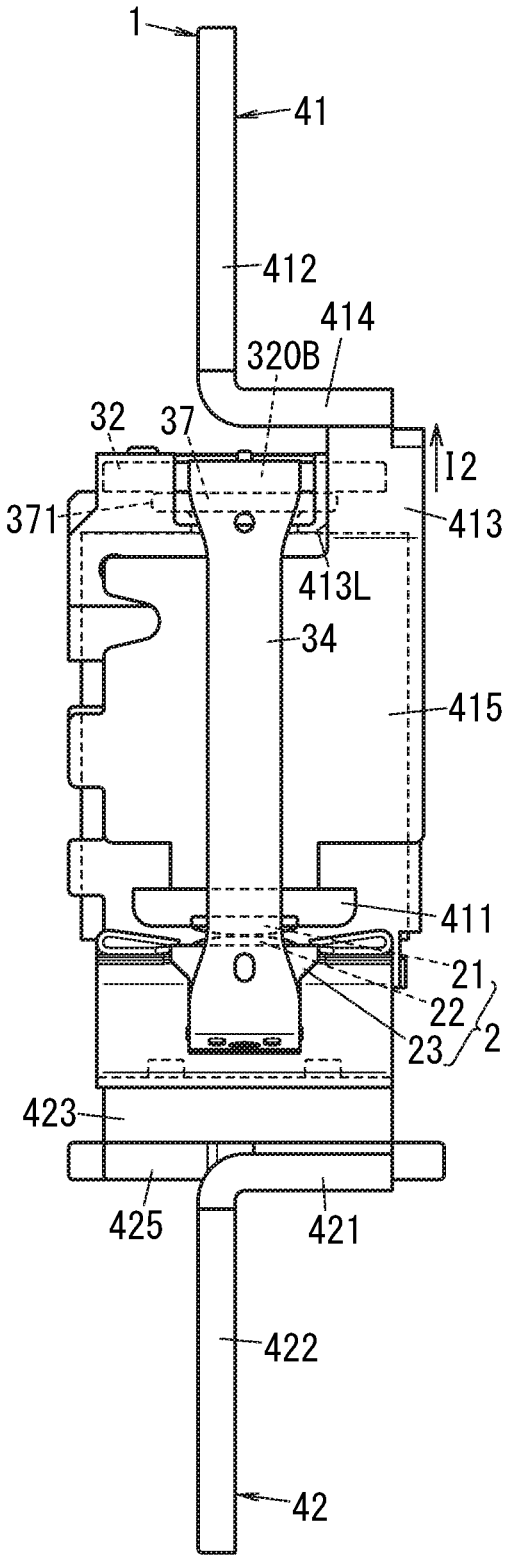
FIG. 3 is a side view of part of the electromagnetic relay.

With the fixed terminal 41, the coil current I1 flows in a direction shown in FIG. 1, and second magnetic flux φ21, φ22 occurs in the fixed terminal 41 by electric current I2 flowing from the movable terminal 42 to the fixed terminal 41 as shown in FIGS. 1 and 2. In this case, the movable terminal 42 is connected to a high potential side and the fixed terminal 41 is connected to a low potential side.

Specifically, when the electric current I2 flows through the fixed terminal 41, the second magnetic flux φ21 occurs around the first crossing piece 413 by the electric current I2 flowing through the first crossing piece 413 that crosses the armature 32. The second magnetic flux φ22 also occurs around the second crossing piece 414 by the electric current I2. The respective directions of the second magnetic flux φ21 and φ22 in the armature 32 are opposite to the direction of the first magnetic flux φ1 generated by the coil current I1.

The second magnetic flux φ21 and φ22 can accordingly reduce the effect of the first magnetic flux φ1 in the armature 32.

The movable terminal 42 is preferably electrically connected to the movable contact 22. The movable terminal 42 preferably includes a fixed piece 421, a terminal piece 422, an attached piece 423, an inclined piece 424 and a link piece 425. For example, the fixed piece 421, the terminal piece 422, the attached piece 423, the inclined piece 424 and the link piece 425 are integrally made of metallic material, thereby constituting the movable terminal 42. Preferably, the fixed piece 421, the attached piece 423, the inclined piece 424 and the link piece 425 are housed in a case 6 (see FIG. 4), and at least part of the terminal piece 422 may be positioned outside the case 6. Remaining part of the terminal piece 422 may be housed in the case 6.

The terminal piece 422 is preferably linked to the fixed piece 421. The terminal piece 422 may have a rectangular plate shape. The terminal piece 422 may be formed with a screw hole 426 pierced in a center thereof and allow a terminal screw (not shown) to be screwed into.

The attached piece 423 may have a rectangular plate shape, and the contact spring 23 is preferably fixed (riveted) to the attached piece 423. The inclined piece 424 may have a rectangular plate shape, and preferably protrudes obliquely downward from a lower end of the attached piece 423. The link piece 425 may have a rectangular plate shape, and preferably links the fixed piece 421 and the inclined piece 424.

Figure 5:
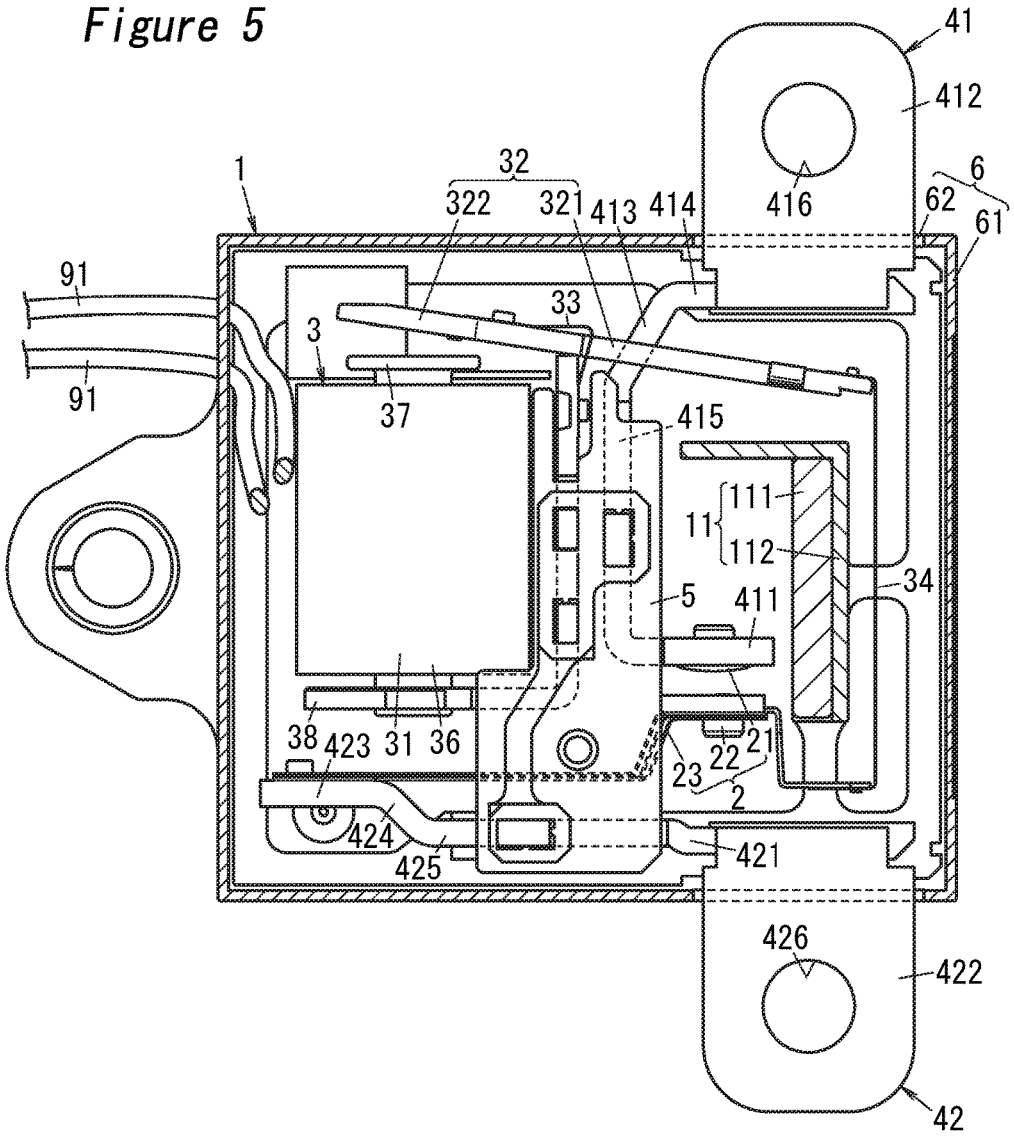
FIG. 5 is a front view of part of the electromagnetic relay when it is off.

As shown in FIG. 5, a positioning member 5 is preferably configured to regulate a relative positional relation of the fixed contact 21, the movable contact 22, the contact spring 23, the electromagnet device 31, the armature 32, the card 34, the fixed terminal 41 and the movable terminal 42. For example, the contact mechanism 2 and the actuator 3 are housed in the case 6 with the electromagnet device 31, the fixed terminal 41 and the movable terminal 42 held by the positioning member 5.

Figure 4:
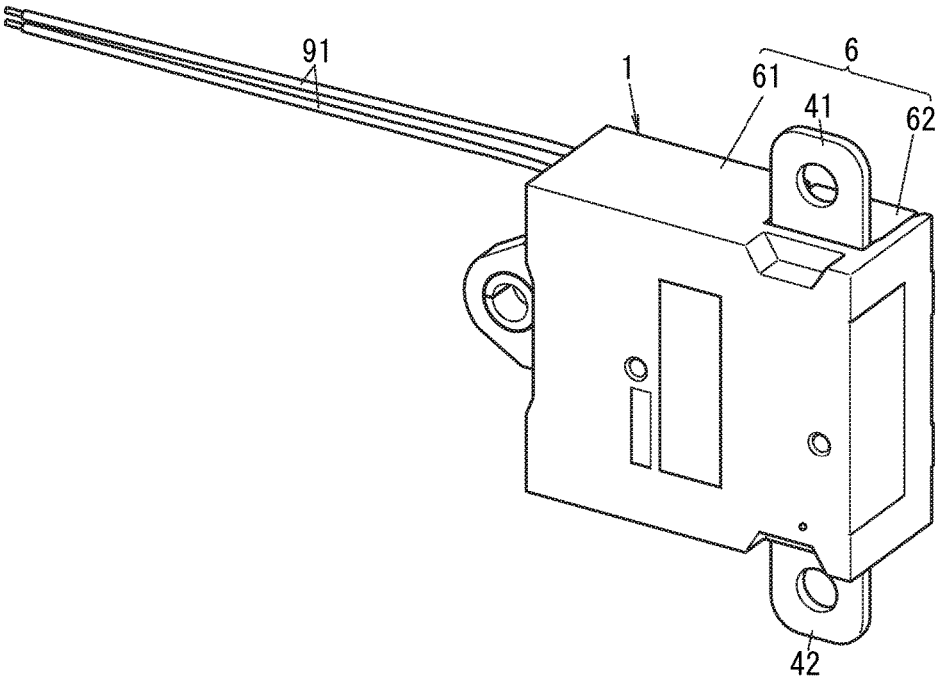
FIG. 4 is a full view of the electromagnetic relay.

As shown in FIGS. 4 and 5, the case 6 preferably houses the contact mechanism 2, the actuator 3 and the positioning member 5. The case 6 preferably includes a base (body) 61 and a cover 62. The base 61 may be a synthetic resin molding with a rectangular case shape, and have an opening in a surface thereof. The cover 62 may be a synthetic resin molding with a rectangular case shape having an opening in a surface thereof. The cover 62 covers the opening of the base 61, thereby coming together to form the case 6.

As shown in FIG. 5, the electromagnetic relay 1 preferably further includes an arc extinction member 11. For example, the arc extinction member 11 is disposed in a space surrounded by the contact mechanism 2 (fixed and movable contacts 21 and 22), the electromagnet device 31, the armature 32 and the card 34 in the base 61. The arc extinction member 11 preferably includes a permanent magnet 111 and a yoke 112. The permanent magnet 111 may have a rectangular plate shape and is preferably magnetized so that it has different poles in a thickness direction thereof. The yoke 112 may have an L shape. For example, the permanent magnet 111 and the yoke 112 are housed in a storage chamber (not shown) provided in the base 61.

For example, two lead wires 91 shown in FIG. 4 are electrically connected to both ends of the coil 36 (see FIG. 5). The lead wires 91 may come out from the case 6 with the wires joined to the coil 36.

Operations of the electromagnetic relay 1 according to Embodiment 1 are now explained with reference to FIGS. 1 to 4. Specifically an operation of the electromagnetic relay 1 used for emergency trip when abnormal current flows as electric current I2 on the occurrence of a fault is explained. In case the electromagnetic relay 1 is used for emergency trip on the occurrence of a fault, ordinarily coil current I1 flows through the coil 36 and the fixed and movable terminals 41 and 42 are in a conduction state (ON state). Ordinarily, a small electric current further flows through the fixed terminal 41. An ordinary electric current I2 has a current value of, for example, several tens to several hundreds of amperes.

An initial operation of the electromagnetic relay 1 before the ordinary operation is first explained. When a switch (not shown) connected in series with the coil 36 changes from off to on with the movable contact 22 separated from the fixed contact 21, voltage is applied across the coil 36 and coil current I1 flows through the coil 36. When the coil current I1 flows through the coil 36, first magnetic flux φ1 occurs in the iron core 37 of the electromagnet device 31. The electromagnet device 31 drives the armature 32 by attraction force of the first magnetic flux φ1, and thereby the armature 32 pivots anticlockwise in FIG. 1. When the armature 32 pivots, the contact spring 23 is pulled up by the card 34 to be bent upward in FIG. 1 and the movable contact 22 touches the fixed contact 21. The fixed and movable terminals 41 and 42 become in a conduction state (ON state). In this case, the first magnetic flux φ1 is comparatively large, and therefore the attraction force by which the iron core 37 attracts the armature 32 becomes large.

The ordinary operation of the electromagnetic relay 1 is next explained. In the ordinary operation, when the abovementioned switch turns from on to off, the voltage is removed from the coil 36 and the coil current I1 stops flowing through the coil 36. When the coil current I1 stops flowing through the coil 36, the armature 32 pivots clockwise in FIG. 1 and the movable contact 22 separates from the fixed contact 21. The fixed and movable contacts 21 and 22 are disposed opposite to each other with a gap therebetween because the contact spring 23 is not pulled by the card 34 when no voltage is applied across the coil 36. In this case, the fixed and movable contacts 21 and 22 become in a non-conduction state (OFF state).

When the fixed and movable terminals 41 and 42 change from the ON state to the OFF state, arc discharge may occur between the fixed and movable contacts 21 and 22. When the arc discharge occurs, it is preferable that the arc discharge be promptly extinguished so that the arc discharge is completed in a short time. On the occurrence of a fault in which electric current I2 flows as abnormal current with an abnormal value that is extremely larger than that in the ordinary operation in particular, the arc discharge needs to be completed immediately.

When the abovementioned abnormal current flows through the fixed and movable terminals 41 and 42 as the electric current I2, the switch (not shown) connected in serial with the coil 36 turns from on to off in response to the detection of the electric current I2 that is the abnormal current. The coil current I1 accordingly stops flowing through the coil 36 as a result of no voltage being applied across the coil 36. In this case, residual magnetization exists in the iron core 37 of the electromagnet device 31. The first magnetic flux φ1 remains in the armature 32 by the residual magnetization. That is, even if the coil current I1 stops flowing through the coil 36, the residual magnetization exists in the iron core 37, thereby hindering the first magnetic flux φ1 from being zero immediately.

The electromagnetic relay 1 according to Embodiment 1 is configured to, by the electric current I2 flowing through the fixed terminal 41, generate second magnetic flux φ21 and φ22 for reducing the effect of the first magnetic flux φ1 after the coil current I1 stops flowing through the coil 36.

Specifically, since the first crossing piece 413 of the fixed terminal 41 crosses the armature 32, the second magnetic flux φ21 occurs anticlockwise in FIG. 2 around the first crossing piece 413 of the fixed terminal 41 when electric current I2 flows through the first crossing piece 413 from lower side to upper side in FIG. 1. In the armature 32, the direction of the second magnetic flux φ21 is opposite to the direction of the first magnetic flux φ1 generated by the coil current I1.

In addition, since the second crossing piece 414 of the fixed terminal 41 crosses the armature 32, the second magnetic flux φ22 occurs anticlockwise in FIG. 1 around the second crossing piece 414 of the fixed terminal 41 when electric current I2 flows through the second crossing piece 414. In the armature 32, the direction of the second magnetic flux φ22 is opposite to the direction of the first magnetic flux φ1 generated by the coil current I1.

As stated above, in the armature 32, the effect of the first magnetic flux φ1 generated by the coil current I1 can be reduced by the second magnetic flux φ21 and φ22 generated by the electric current I2. It is therefore possible to increase the opening speed of the fixed and movable contacts 21 and 22 in comparison with an electromagnetic relay having a configuration in which fixed and movable contacts are separated from an armature by a supporting member that supports the movable contact.

An operation when the movable contact 22 is separated from the fixed contact 21 is hereinafter explained in detail. Even if the second magnetic flux φ21 and φ22 for reducing the effect of the first magnetic flux φ1 caused by the residual magnetization of the iron core 37 occurs after the coil current I1 stops flowing through the coil 36, the armature 32 is still attracted to the iron core 37 without separating from the iron core 37 immediately owing to the attraction force caused by the first magnetic flux φ1.

However, the contact spring 23 has elastic force larger than the attraction force, and therefore the armature 32 is about to separate from the iron core 37. When the contact spring 23 separates from the iron core 37 to some degree, the speed that the armature 32 separates from the iron core 37 becomes large. It is therefore possible to increase the opening speed in a period of time from when the coil current I1 stops flowing through the coil 36 to when the movable contact 22 separates from the fixed contact 21.

As stated above, increasing the opening speed enables prompt extinction of arc discharge generated between the fixed and movable contacts 21 and 22.

In order to realize the prompt extinction of arc discharge generated between the fixed and movable contacts 21 and 22, the electromagnetic relay 1 according to Embodiment 1 is provided with, for example, the arc extinction member 11 including the permanent magnet 111 and yoke 112. That is, the permanent magnet 111 and yoke 112 forms magnetic field around the fixed and movable contacts 21 and 22 to elongate arc by electromagnetic force derived from the magnetic field, thereby extinguishing arcing.

As explained above, in the electromagnetic relay 1 according to Embodiment 1, the fixed terminal 41 is provided around the armature 32 with the fixed terminal 41 crossing the armature 32 as seen from a direction perpendicular to the first direction of the armature 32 with the armature 32 forcing the movable contact 22 to touch the fixed contact 21. The electric current I2 flowing through the fixed terminal 41 generates the second magnetic flux φ21 and φ22, respective directions of which are opposite to the direction of the first magnetic flux φ1 generated by the coil current I1 flowing through the coil 36. That is, by regulating a winding direction of the coil 36, polarity of coil current I1 and polarity of electric current I2 through the fixed terminal 41, the second magnetic flux φ21 and φ22 is generated in a direction opposite to the first magnetic flux φ1.

The electromagnetic relay 1 according to Embodiment 1 can reduce the effect of the first magnetic flux φ1, which is generated in the armature 32 by the coil current I1 flowing through the coil 36, by the second magnetic flux φ21 and φ22 generated by the electric current I2 flowing through the fixed terminal 41. It is accordingly possible to increase the opening speed when the movable contact 22 is separated from the fixed contact 21 with a large abnormal current flowing through the fixed terminal 41 as the electric current I2. That is, the movable contact 22 can be separated from the fixed contact 21 in a short time.

The electromagnetic relay 1 according to Embodiment 1 can further increase the opening speed by reducing the effect of the first magnetic flux φ1, which is generated in the armature 32 by the coil current I1, at two places of the fixed terminal 41 (first and second crossing pieces 413 and 414).

Note that the direction of the first magnetic flux φ1 generated by the coil current I1 may be opposite to the direction in FIG. 1, provided that the direction of the electric current I2 is also opposite to the direction in FIG. 1. That is, the electric current I2 needs to flow from the fixed terminal 41 to the movable terminal 42. The respective directions of the second magnetic flux φ21 and φ22 can accordingly be made opposite to those in FIGS. 1 and 2. As a result, the respective directions of the second magnetic flux φ21 and φ22 can be made opposite to the direction of the first magnetic flux φ1.

Embodiment 2

Figure 7:
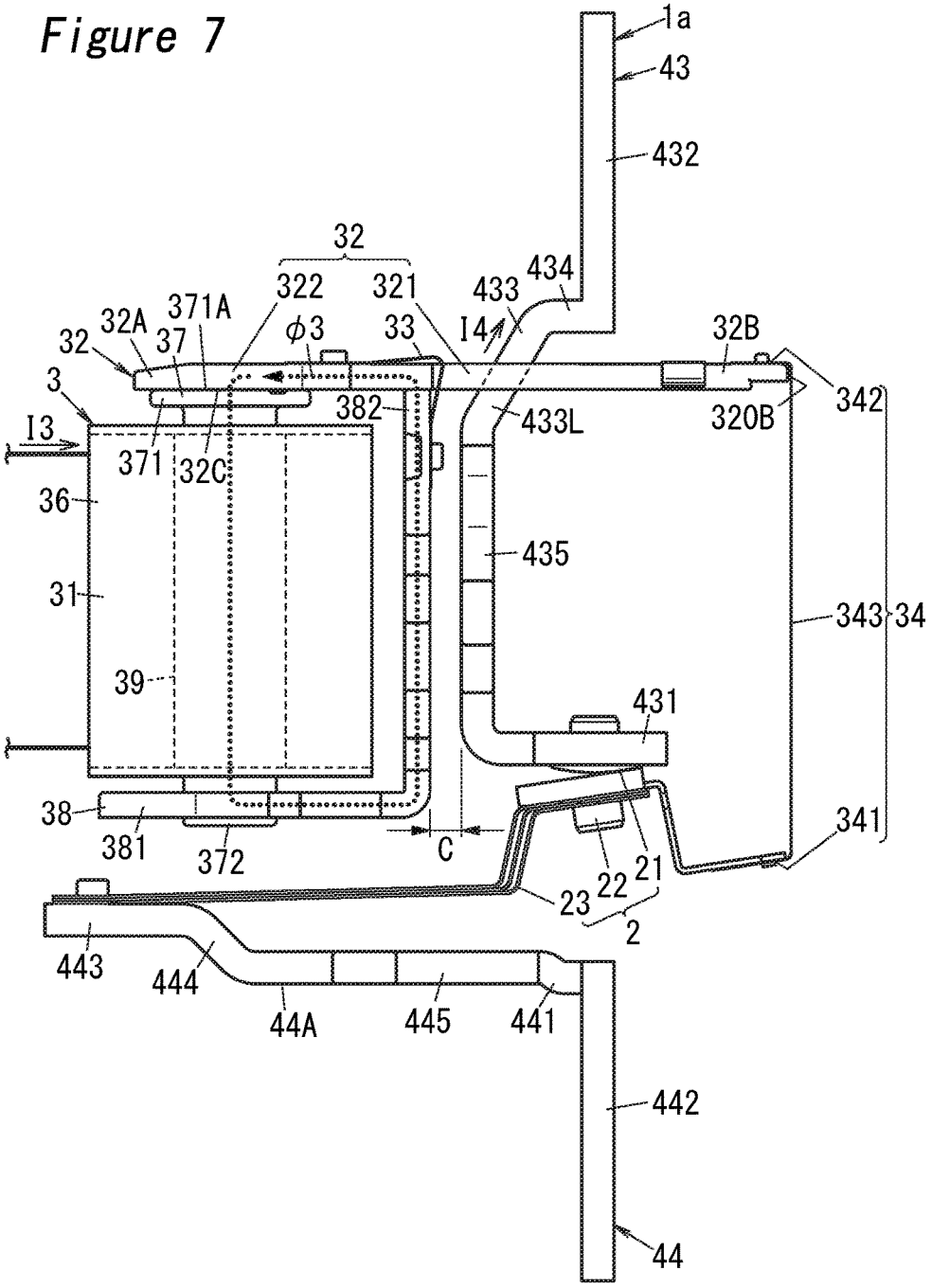
FIG. 7 is a front view of part of an electromagnetic relay when it is on, in accordance with Embodiment 2 of the present disclosure.
Figure 8:
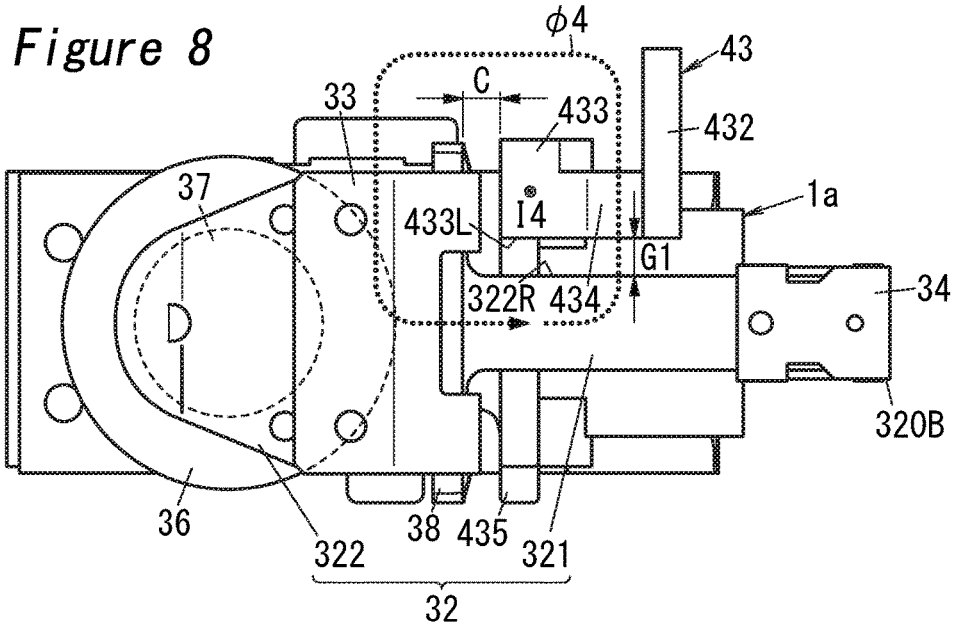
FIG. 8 is a plan of part of the electromagnetic relay.
Figure 9:
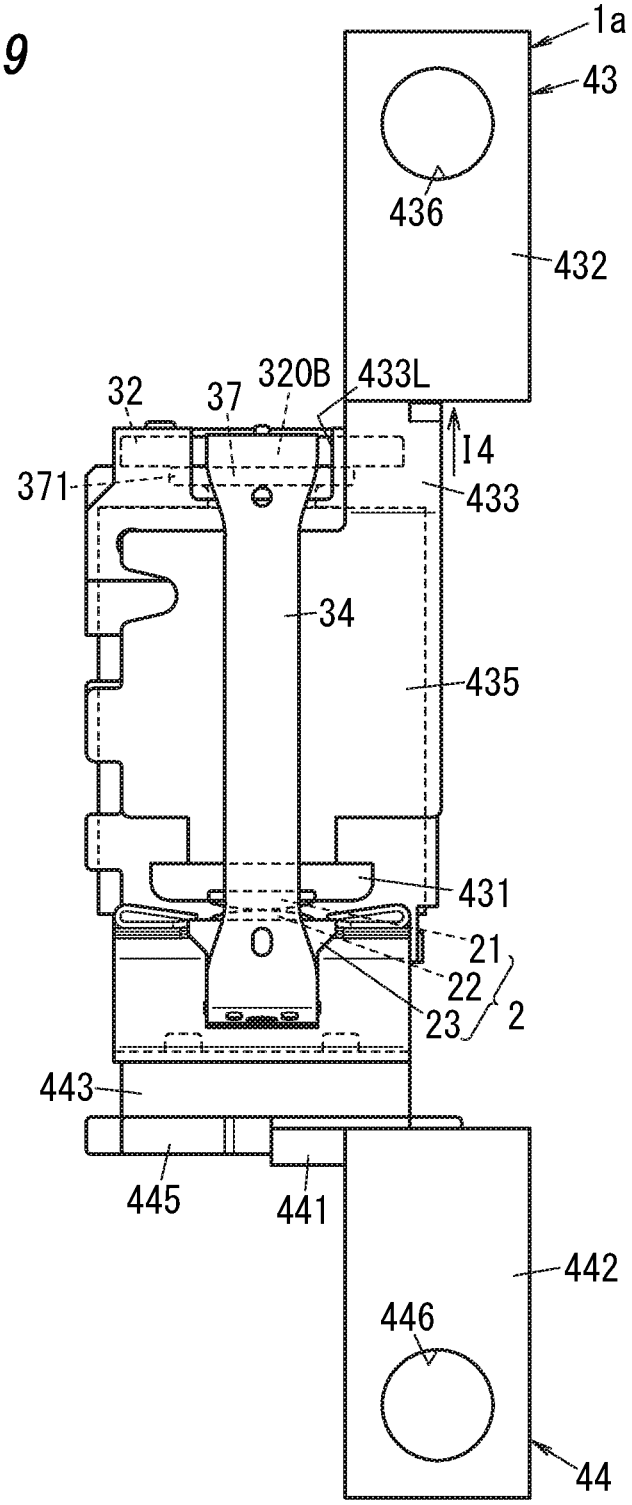
FIG. 9 is a side view of part of the electromagnetic relay.

As shown in FIGS. 7 to 9, an electromagnetic relay 1*a* according to Embodiment 2 differs from the electromagnetic relay 1 according to Embodiment 1 (see FIG. 1) in that the effect of first magnetic flux φ3 generated in an armature 32 by coil current I3 is reduced at one place of a fixed terminal 43 (crossing piece 433). Note that like kind elements are assigned the same reference numerals as depicted in Embodiment 1, and are not explained herein.

In Embodiment 2, the fixed terminal 43 is preferably provided around the armature 32 so as to cross the armature 32 as seen from only one direction (a direction perpendicular to the sheet of FIG. 7, a vertical direction in FIG. 8) to a lengthwise direction (first direction) of the armature 32. Note that explanation of functions, similar to the fixed terminal 41 (see FIG. 1) in Embodiment 1, of the fixed terminal 43 in Embodiment 2 is omitted.

Figure 10:
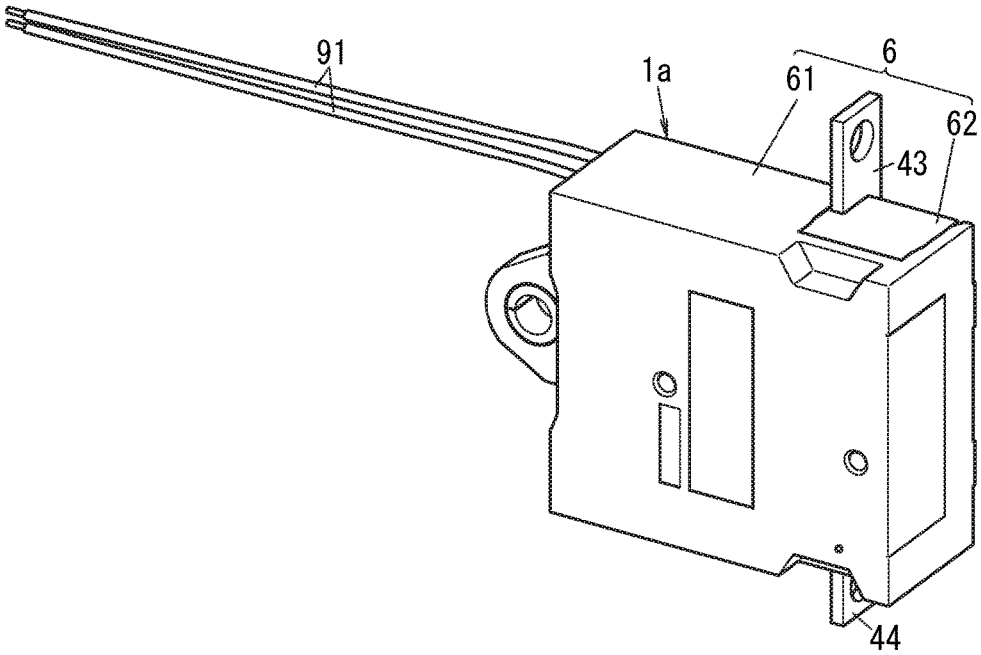
FIG. 10 is a full view of the electromagnetic relay.
Figure 11:
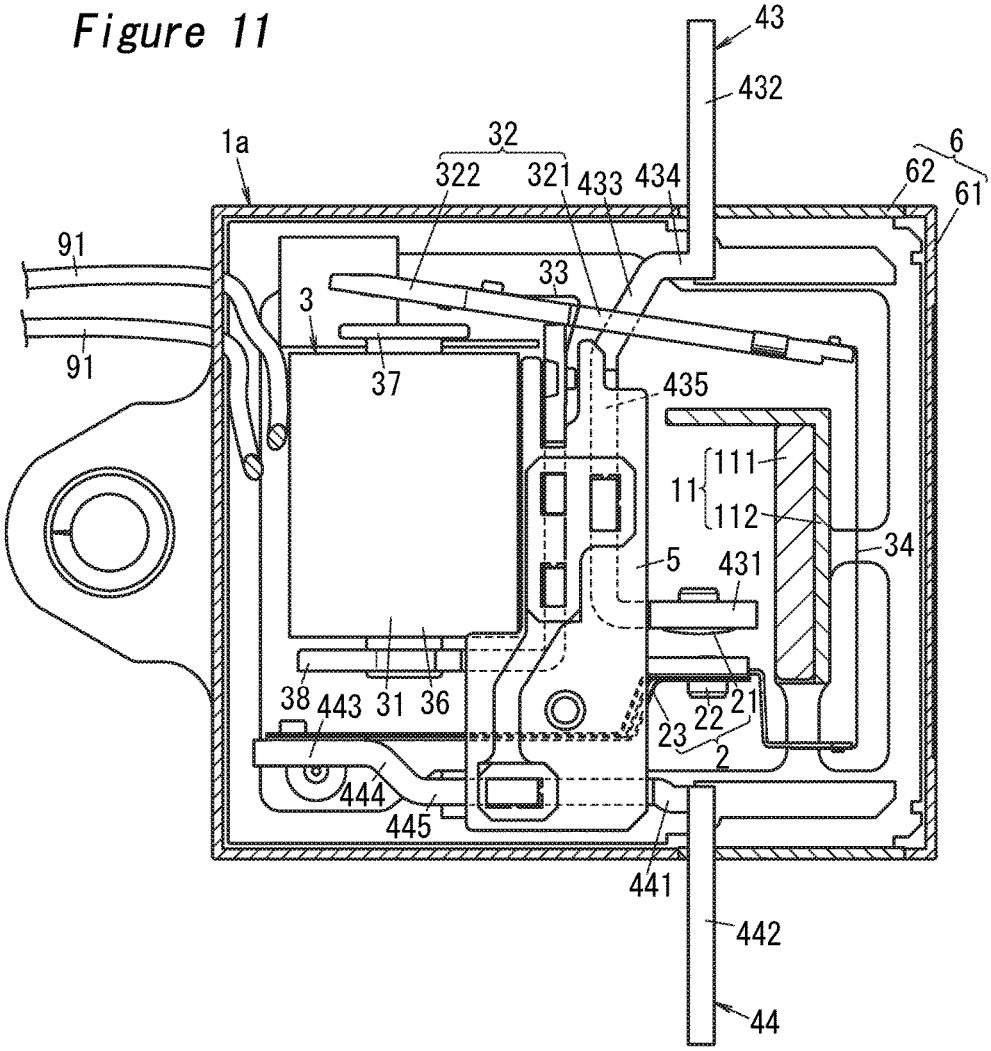
FIG. 11 is a front view of part of the electromagnetic relay when it is off.

The fixed terminal 43 preferably includes an attachment piece 431, a terminal piece 432, the crossing piece 433, a connection piece 434 and a link piece 435. The attachment piece 431, the terminal piece 432, the crossing piece 433, the connection piece 434 and the link piece 435 are integrally made of metallic material, thereby constituting the fixed terminal 43. The attachment piece 431, the crossing piece 433, the connection piece 434 and the link piece 435 may be housed in a case 6 (see FIG. 10). At least part of the terminal piece 432 may be positioned outside the case 6. Remaining part of the terminal piece 432 may be housed in the case 6.

The attachment piece 431 may have a rectangular plate shape, and preferably a fixed contact 21 is attached at a center of the attachment piece 431.

The terminal piece 432 preferably allows external equipment (not shown) to be electrically connected to. The terminal piece 432 is preferably linked to the connection piece 434. The terminal piece 432 may have a rectangular plate shape. The terminal piece 432 may be formed with a screw hole 436 pierced in a center thereof and allow a terminal screw (not shown) to be screwed into.

The crossing piece 433 preferably crosses the armature 32 as seen from the direction (the direction perpendicular to the sheet of FIG. 7, the vertical direction in FIG. 8) perpendicular to the lengthwise direction of the armature 32.

For example, the connection piece 434 is elongated along the armature 32 and connects the terminal piece 432 and the crossing piece 433.

The link piece 435 may have a rectangular plate shape and preferably links the attachment piece 431 and the crossing piece 433.

With the fixed terminal 43, for example, the coil current I3 flows in a direction shown in FIG. 7, and electric current I4 flowing from a movable terminal 44 to the fixed terminal 41 generates second magnetic flux φ4 in the fixed terminal 43. In this example, the movable terminal 44 is connected to a high potential side and the fixed terminal 43 is connected to a low potential side.

Figure 12:
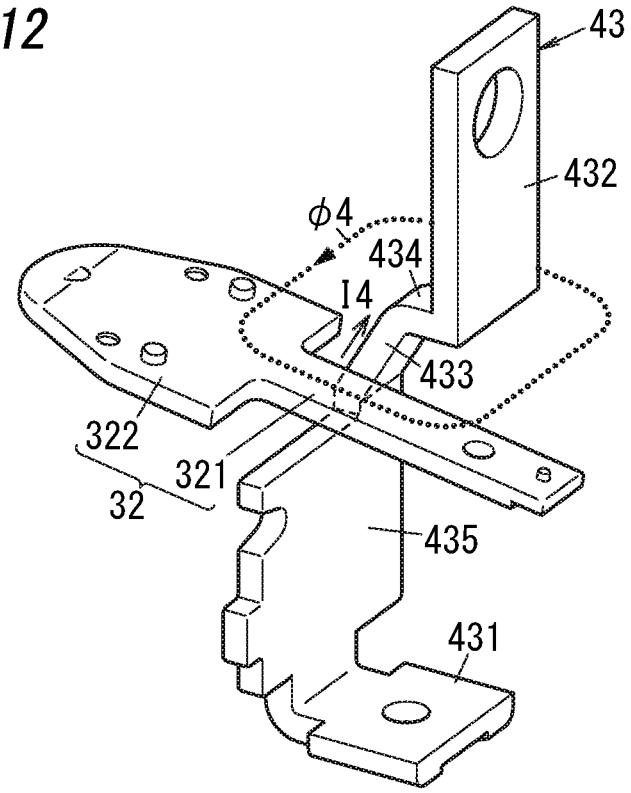
FIG. 12 is a perspective view of an armature and a fixed contact of the electromagnetic relay.

Specifically, as shown in FIG. 12, when the electric current I4 flows through the fixed terminal 43, the electric current I4 flowing through the crossing piece 433 that crosses the armature 32 generates the second magnetic flux φ4 around the crossing piece 433. The direction of the second magnetic flux φ4 in the armature 32 is opposite to the direction of the first magnetic flux φ3 generated by the coil current I3 (see FIG. 7).

The second magnetic flux φ4 can accordingly reduce the effect of the first magnetic flux φ3 in the armature 32.

The movable terminal 44 is preferably electrically connected to the movable contact 22. The movable terminal 44 preferably includes a fixed piece 441, a terminal piece 442, an attached piece 443, an inclined piece 444 and a link piece 445. For example, the fixed piece 441, the terminal piece 442, the attached piece 443, the inclined piece 444 and the link piece 445 are integrally made of metallic material, thereby constituting the movable terminal 44. The fixed piece 441, the attached piece 443, the inclined piece 444 and the link piece 445 are preferably housed in the case 6 (see FIG. 10). At least part of the terminal piece 442 may be positioned outside the case 6. Remaining part of the terminal piece 442 may be housed in the case 6.

The terminal piece 442 is preferably linked to the fixed piece 441. The terminal piece 442 may have a rectangular plate shape. The terminal piece 442 may be formed with a screw hole 446 pierced in a center thereof (see FIG. 9) and allow a terminal screw (not shown) to be screwed into.

The attached piece 443 may have a rectangular plate shape, and a contact spring 23 is preferably fixed (riveted) thereto. The inclined piece 444 may have a rectangular plate shape, and preferably protrudes obliquely downward from the attached piece 443. The link piece 445 may have a rectangular plate shape, and preferably links the fixed piece 441 and the inclined piece 444.

Operations of the electromagnetic relay 1*a* according to Embodiment 2 are now explained with reference to FIGS. 7 to 9. For example, an operation of the electromagnetic relay 1 used for emergency trip when abnormal current flows as the electric current I4 on the occurrence of a fault is explained. In this case, the electromagnetic relay 1*a* is ordinarily in an ON state and a small electric current I4 flows through the fixed terminal 43. An ordinary electric current I4 has a current value of, for example, several tens to several hundreds of amperes. When voltage is applied across a coil 36 with the movable contact 22 separated from the fixed contact 21, an electromagnet device 31 drives the armature 32 and thereby the armature 32 pivots anticlockwise in FIG. 7. The contact spring 23 is accordingly pulled up with a card 34 to be bent upward in FIG. 7 and the movable contact 22 touches the fixed contact 21. The fixed and movable terminals 43 and 44 become in a conduction state (ON state).

In the ON state, when the voltage is removed from the coil 36, the armature 32 pivots clockwise in FIG. 7 and the electromagnetic relay 1*a* becomes in an OFF state.

Here, when abnormal current flows though the fixed terminal 43 as the electric current I4, a switch (not shown) connected in series with the coil 36 is turned from on to off in response to detection of the electric current I4 that is the abnormal current. In this case, the first magnetic flux φ3 remains in the armature 32. The abnormal current has an abnormal value that is extremely larger than that in the ordinary operation.

The electromagnetic relay 1*a* according to Embodiment 2 generates the second magnetic flux φ4 for reducing the effect of the first magnetic flux φ3 by the electric current I4 flowing through the fixed terminal 41. Specifically, since the crossing piece 433 of the fixed terminal 43 crosses the armature 32, the second magnetic flux φ4 is generated around the crossing piece 443 of the fixed terminal 43 when electric current I4 flows through the crossing piece 433. In the armature 32, the direction of the second magnetic flux φ4 is opposite to the direction of the first magnetic flux φ3 generated by the coil current I3.

As explained above, the electromagnetic relay 1*a* according to Embodiment 2 can also reduce the effect of the first magnetic flux φ3 in the armature 32, which is generated by the coil current I3, by the second magnetic flux φ4 generated by the electric current I4. An opening speed of the fixed and movable contacts 21 and 22 can therefore be increased like the electromagnetic relay 1 according to Embodiment 1 in comparison with an electromagnetic relay having a configuration in which fixed and movable contacts are separated from an armature by a supporting member that supports the movable contact.

Note that the direction of the first magnetic flux φ3 generated by the coil current I3 may be opposite to the direction in FIG. 7, provided that the direction of the electric current I4 is also opposite to the direction in FIG. 7. That is, the electric current I4 needs to flow from the fixed terminal 43 to the movable terminal 44. The direction of the second magnetic flux φ4 can accordingly be made opposite to that in FIG. 8. As a result, the direction of the second magnetic flux φ4 can be made opposite to the direction of the first magnetic flux φ3.

Figure 13:
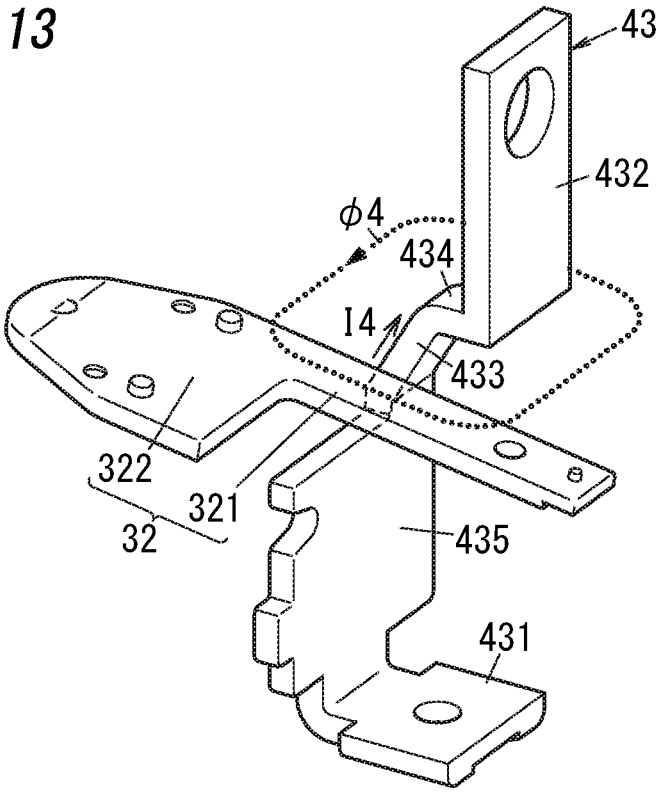
FIG. 13 is a perspective view of an armature and a fixed contact in Modified Example 1 of the electromagnetic relay.

As Modified Example 1 in Embodiment 2, a driving piece 321 having a tabular band shape of an armature 32 may be continuous from not center part of a supporting piece 322 but right part thereof as shown in FIG. 13. Even in Modified Example 1, a crossing piece 433 of a fixed terminal 43 is provided around the driving piece 321, and therefore second magnetic flux φ4 is generated so as to reduce the effect of the first magnetic flux φ3 generated in the armature 32 by coil current I3 (see FIG. 7) when electric current I4 flows through the fixed terminal 43.

An electromagnetic relay 1*a* in Modified Example 1 can therefore increase an opening speed of fixed and movable contacts 21 and 22.

Figure 14:
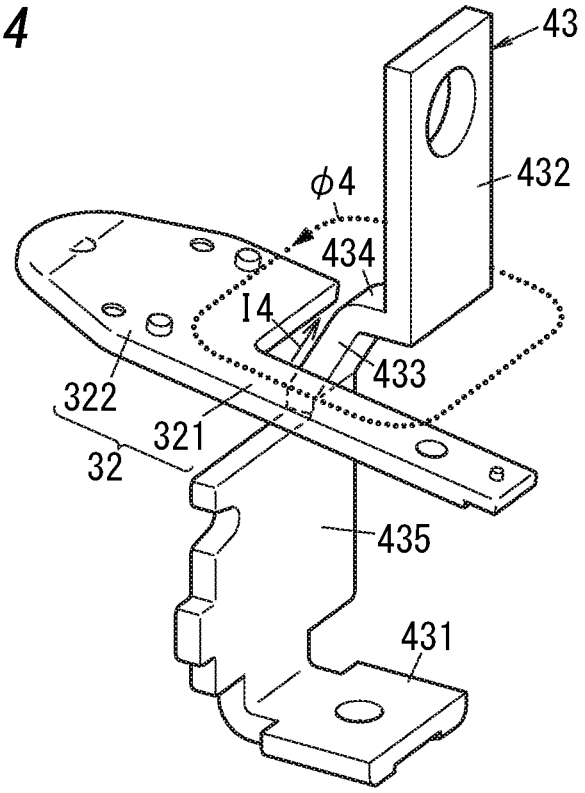
FIG. 14 is a perspective view of an armature and a fixed contact in Modified Example 2 of the electromagnetic relay

As Modified Example 2 in Embodiment 2, a driving piece 321 having a tabular band shape of an armature 32 may be continuous from not center part of a supporting piece 322 but left part thereof as shown in FIG. 14. Even in Modified Example 2, a crossing piece 433 of a fixed terminal 43 is provided around the driving piece 321, and therefore second magnetic flux φ4 is generated so as to reduce the effect of the first magnetic flux φ3 generated in the armature 32 by coil current I3 (see FIG. 7) when electric current I4 flows through the fixed terminal 43.

An electromagnetic relay 1*a* in Modified Example 2 can therefore increase an opening speed of fixed and movable contacts 21 and 22.

Figure 15:
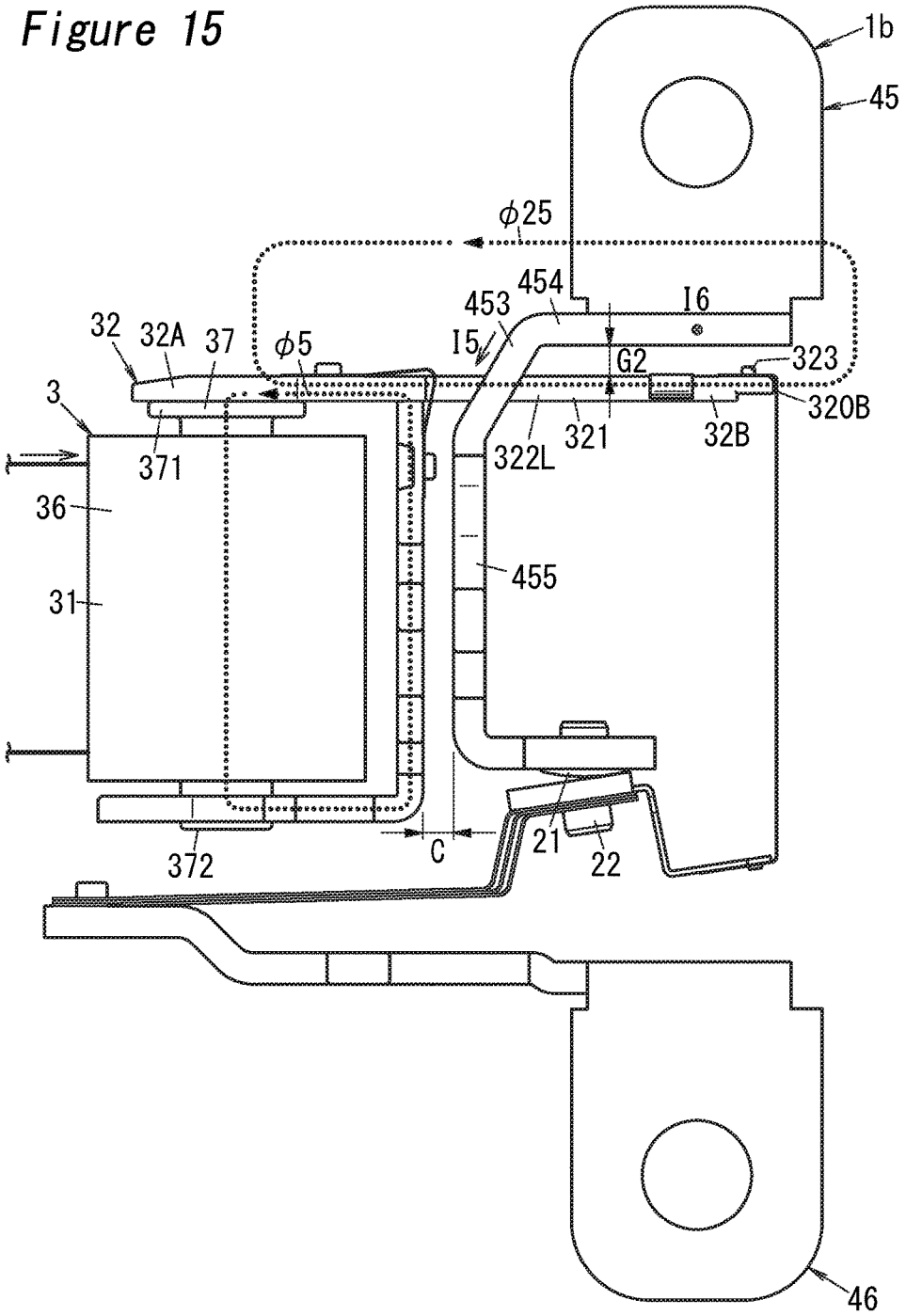
FIG. 15 is a front view of part of an electromagnetic relay when it is on, in accordance with another embodiment of the present disclosure.
Figure 16:
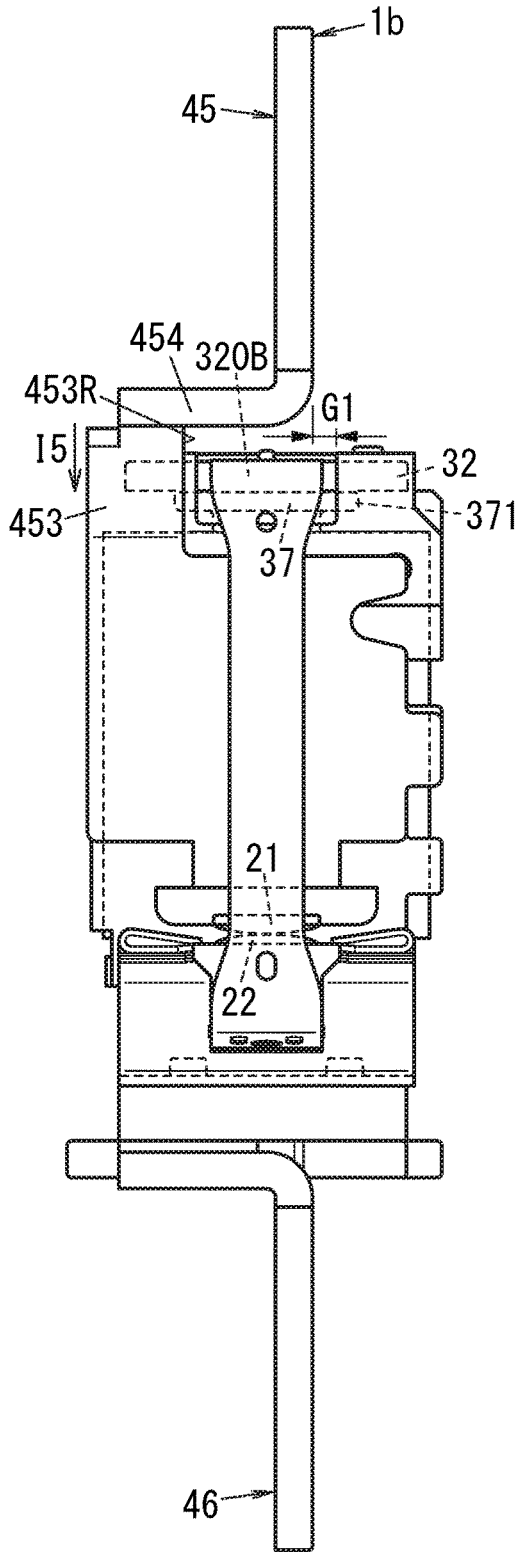
FIG. 16 is a side view of part of the electromagnetic relay.

As shown in FIGS. 1, 7 and 15, an electromagnetic relay 1, 1*a*, 1*b* of the present disclosure includes, as a basic configuration, a fixed contact 21, a movable contact 22, an armature 32, an electromagnet device 31, a first terminal 41, 43, 45 and a second terminal 42, 44, 46. The armature 32 is elongated and has a first end 32A and a second end 32B in a lengthwise direction thereof. The electromagnet device 31 includes an iron core 37 having a first end 371 and a second end 372, and a coil 36 of wire wound around the iron core 37. The electromagnet device 31 is configured to generate magnetic flux φ1, φ3, φ5 when the coil 36 is energized, thereby causing the first end 371 of the iron core 37 to attract the first end 32A of the armature 32. The magnetic flux φ1, φ3, φ5 starts at the second end 372 of the iron core 37 and ends at the first end 371 of the iron core 37 through the armature 32. The first terminal 41, 43, 45 is electrically connected with the fixed contact 21. The second terminal 42, 44, 46 is electrically connected with the movable contact 22. The second terminal 42, 44, 46 movably holds the movable contact 22 so that when the first end 371 of the iron core 37 attracts the first end 32A of the armature 32, the armature 32 moves the movable contact 22 to force the movable contact 22 to touch the fixed contact 21. Note that the magnetic flux in the iron core 37 starts at the first end 371 and ends at the second end 372, and therefore the magnetic flux forms a closed loop as a whole.

In a first example, the armature 32 is a flat rectangular armature, and the electromagnet device 31 is configure to drive the armature 32 so that a face 32C of the first end 32A of the armature 32 and an end face 371A of the first end 371 of the iron core 37 are respectively forced together and apart when the coil 36 is energized and de-energized.

In a second example, the electromagnet device 31 further includes a yoke 38 for forming a closed magnetic circuit along with the iron core 37 and part of the armature 32, and the yoke 38 has a first end 381 fixed to the second end 372 of the iron core 37, and a second end 382. With this example, it is preferable that the armature 32 be hinged at the second end 382 of the yoke 38. It is also preferable that the electromagnet device 31 further includes a spring (hinge spring) 33 fixed to the armature 32 and the yoke 38 so as to separate the movable contact 22 from the fixed contact 21 through the armature 32 when the coil 36 is de-energized.

In a third example, the first terminal 41, 43 is a single electrical conductor.

In a fourth example, the second terminal 42, 44 includes a contact spring 23 electrically and mechanically connected with the movable contact 22, and a terminal body 42A, 44A electrically and mechanically connected with the contact spring 23. With this example, it is preferable that the electromagnetic relay 1, 1*a* further include an intermediate member 34 intervening between the armature 32 and the contact spring 23, and that the electromagnet device 31 be configured to move the movable contact 22 through the armature 32 and the intermediate member 34. Note that the intermediate member 34 may be an electrical conductor or an electrical insulator.

In a fifth example, the electromagnet device 31 further includes a bobbin 39 between the iron core 37 and the coil 36.

In a first aspect having the basic configuration and five options described in the first to fifth examples, the first terminal 41, 43 and the second terminal 42, 44 are a negative terminal and a positive terminal that allow direct current voltage to be applied across, respectively, and the first terminal 41, 43 includes a crossing piece 413, 433. Herein, as seen from an end face 320B of the second end 32B of the armature 32 with a side of the first end 371 of the iron core 37 up (see FIGS. 3 and 9), a left edge 413L, 433L of the crossing piece 413, 433 crossing a right edge 322R of the armature 32 (see FIGS. 2 and 8), and a lower side of the crossing piece 413, 433 is electrically connected to the fixed contact 21 (see FIGS. 1 and 7).

In a first preferable example of the first aspect, a gap G1 (see FIGS. 2 and 8), which is a minimum distance between the crossing piece 413, 433 and the armature 32, equals a clearance (minimum distance) C between the yoke 38 and the first terminal 41, 43 (see FIGS. 1 and 7). In the illustrated examples, the gap G1 between the crossing piece 413, 433 and part of minimum width of the armature 32 (e.g., driving piece 321) is equal to the clearance C.

In a second preferable example of the first aspect (see FIG. 3), the first terminal 41 further includes a crossing piece 414 that crosses at least part of the armature 32 from right to left of the armature 32 as seen from the end face 320B. Herein, though a gap G2, which is a minimum distance between the crossing piece 414 and the driving piece 321 of the armature 32, may equal the clearance C as shown in FIG. 1, a gap between the crossing piece 414 and a nib 323 for connection with a second fixed portion 342 provided on the driving piece 321 may equal the clearance C. Alternatively, the nib 323 may be formed to protrude from the end face 320B of the armature 32 to hold the second fixed portion 342. Note that preferably the crossing piece 414 is provided so as to cross at least part of the armature 32 leftward from an upper side of the crossing piece 413 as seen from the end face 320B.

In a second aspect having the basic configuration and five options described in the first to fifth examples, the first terminal 45 and the second terminal 46 are a positive terminal and a negative terminal that allow direct current voltage to be applied across, respectively, and the first terminal 45 includes a crossing piece 453. Herein, as seen from an end face 320B of the second end 32B of the armature 32 with a side of the first end 371 of the iron core 37 up (see FIG. 14), a right edge 453R of the crossing piece 453 crossing a left edge 322L of the armature 32 (see FIGS. 13 and 14), and a lower side of the crossing piece 453 is electrically connected to the fixed contact 21 (see FIG. 13).

With the second aspect, electric current I5 flowing through the crossing piece 453 generates magnetic flux (not shown), a direction of which is opposite to that of the magnetic flux φ5. It is therefore possible to increase an opening speed of the fixed and movable contacts 21 and 22.

In a first preferable example of the second aspect, a gap G1 (see FIG. 14), which is a minimum distance between the crossing piece 453 and the armature 32, equals a clearance (minimum distance) C between the yoke 38 and the first terminal 45 (see FIG. 13).

In a second preferable example of the second aspect (see FIG. 14), the first terminal 45 further includes a crossing piece 454 that crosses at least part of the armature 32 from left to right of the armature 32 as seen from the end face 320B. Herein, though a gap G2, which is a minimum distance between the crossing piece 454 and the driving piece 321 of the armature 32, may equal the clearance C as shown in FIG. 13, a gap between the crossing piece 454 and a nib 323 for connection with a second fixed portion 342 provided on the driving piece 321 may equal the clearance C. Alternatively, the nib 323 may be formed to protrude from the end face 320B of the armature 32 to hold the second fixed portion 342. Note that preferably the crossing piece 454 is provided so as to cross at least part of the armature 32 rightward from an upper side of the crossing piece 453 as seen from the end face 320B.

With the second preferable example, electric current I6 flowing through the crossing piece 454 generates magnetic flux (not shown), a direction of which is opposite to that of the magnetic flux φ5.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. An electromagnetic relay, comprising:

a fixed contact;

a movable contact that makes or breaks a connection with the fixed contact;

an electromagnet device that includes a coil and generates first magnetic flux by coil current flowing through the coil;

an armature, a first end in a first direction of which comes into contact with the electromagnet device and separates therefrom by the first magnetic flux, a second end in the first direction of the armature being connected with the movable contact, the armature forcing the fixed and movable contacts together and apart according to the coil current; and a fixed terminal that is electrically connected to the fixed contact, wherein the fixed terminal that is provided around the armature with the fixed terminal crossing the armature as seen from at least one direction perpendicular to the first direction of the armature when the armature causes the movable contact to touch the fixed contact, electric current flowing through the fixed terminal generating a second magnetic flux in the armature, a direction of which is opposite to that of the first magnetic flux.

2. The electromagnetic relay of claim 1, wherein the fixed terminal is provided around the armature with the fixed terminal crossing the armature as seen from two directions perpendicular to the first direction of the armature.

3. The electromagnetic relay of claim 2, wherein the fixed terminal comprises an attached piece to which the fixed contact is attached, a terminal piece that allows external equipment to be electrically connected thereto, a first crossing piece that crosses the armature as seen from a second direction of the two directions perpendicular to the first direction, and a second crossing piece that connects the first crossing piece and the terminal piece and that crosses the armature as seen from a third direction of the two directions perpendicular to the first direction.

4. The electromagnetic relay of claim 1, wherein the fixed terminal is provided around the armature with the fixed terminal crossing the armature as seen from only one direction perpendicular to the first direction of the armature.

5. The electromagnetic relay of claim 4, wherein the fixed terminal comprises an attached piece to which the fixed contact is attached, a terminal piece that allows external equipment to be electrically connected thereto, a crossing piece that crosses the armature as seen from said one direction, and a connection piece that connects the crossing piece and the terminal piece and that is elongated along the armature.

6. An electromagnetic relay, comprising:

a fixed contact;

a movable contact;

an armature that is elongated and has a first end and a second end in a lengthwise direction thereof;

an electromagnet device that includes an iron core having a first end and a second end, and a coil of wire wound around the iron core, and that is configured to generate magnetic flux when the coil is energized, thereby causing the first end of the iron core to attract the first end of the armature, said magnetic flux starting at the second end of the iron core and ending at the first end of the iron core through the armature;

a first terminal that is electrically connected with the fixed contact; and a second terminal that is electrically connected with the movable contact and that movably holds the movable contact so that when the first end of the iron core attracts the first end of the armature, the armature moves the movable contact to force the movable contact to touch the fixed contact, wherein the first terminal and the second terminal are a negative terminal and a positive terminal that allow direct current voltage to be applied thereacross, respectively, and the first terminal comprises a crossing piece, as seen from an end face of the second end of the armature with a side of the first end of the iron core up, a left edge of the crossing piece crossing a right edge of the armature, and a lower side of the crossing piece is electrically connected to the fixed contact.

7. The electromagnetic relay of claim 6, wherein the first terminal further comprises a crossing piece that crosses at least part of the armature from right to left of the armature as seen from the end face.

8. An electromagnetic relay, comprising:

a fixed contact;

a movable contact;

an armature that is elongated and has a first end and a second end in a lengthwise direction thereof;

an electromagnet device that includes an iron core having a first end and a second end, and a coil of wire wound around the iron core, and that is configured to generate magnetic flux when the coil is energized, thereby causing the first end of the iron core to attract the first end of the armature, said magnetic flux starting at the second end of the iron core and ending at the first end of the iron core through the armature;

a first terminal that is electrically connected with the fixed contact; and a second terminal that is electrically connected with the movable contact and that movably holds the movable contact so that when the first end of the iron core attracts the first end of the armature, the armature moves the movable contact to force the movable contact to touch the fixed contact, wherein the first terminal and the second terminal are a positive terminal and a negative terminal that allow direct current voltage to be applied thereacross, respectively, and the first terminal comprises a crossing piece, as seen from an end face of the second end of the armature with a side of the first end of the iron core up, a right edge of the crossing piece crossing a left edge of the armature, and a lower side of the crossing piece is electrically connected to the fixed contact.

9. The electromagnetic relay of claim 8, wherein the first terminal further comprises a crossing piece that crosses at least part of the armature from left to right of the armature as seen from the end face.

* * * * *